United States Patent [19]

Hansen et al.

[11] Patent Number: 4,753,259

[45] Date of Patent: Jun. 28, 1988

[54] ADJUSTABLE FOLDING WALKING AID

[76] Inventors: Ries B. Hansen, 8241 N. River Rd., River Hills, Wis. 53217; Howard G. Morter, 1598 N. Coveredbridge Rd., Cedarburg, Wis. 53012

[21] Appl. No.: 34,476

[22] Filed: Apr. 3, 1987

[51] Int. Cl.[4] ..... A61H 3/02

[52] U.S. Cl. ..... 135/68; 403/100

[58] Field of Search ..... 403/100, 101, 102, 325, 403/330, 59, 61, 161; 135/68, 69, 74, 75; 272/78, 142

[56] References Cited

U.S. PATENT DOCUMENTS

| | | | |
|---|---|---|---|
| Re. 28,067 | 7/1974 | Hyman | 135/74 |
| 469,592 | 2/1892 | Parkes | 403/100 |
| 972,284 | 10/1910 | Storey | 272/142 |
| 1,400,394 | 12/1921 | Warry | 135/69 |
| 1,446,835 | 2/1923 | Cook | 272/78 |
| 1,534,820 | 4/1925 | Walmsley | 403/100 |
| 3,635,233 | 1/1972 | Robertson | 135/71 |
| 3,655,297 | 4/1972 | Bolen, Jr. et al. | 135/74 |
| 3,730,544 | 5/1973 | Hyman | 135/65 |
| 3,886,962 | 6/1975 | Diamontis | 135/69 |
| 4,253,478 | 3/1981 | Husa | 135/74 |
| 4,437,480 | 3/1984 | Husa | 135/74 |
| 4,527,579 | 7/1985 | Knotter et al. | 135/74 |

FOREIGN PATENT DOCUMENTS

| | | | |
|---|---|---|---|
| 126298 | 8/1931 | Fed. Rep. of Germany | 135/68 |
| 187372 | 10/1922 | United Kingdom | 403/100 |

*Primary Examiner*—Robert A. Hafer
*Assistant Examiner*—Charles H. Sam
*Attorney, Agent, or Firm*—C. Thomas Sylke; John C. Cooper, III; Fred Wiviott

[57] ABSTRACT

A hinge element consists of a tube connector attached to the end of a tube, the end of the tube connector having a notched head portion. Pivotably attached to the notched head of the connector is a bracket element having a spherically shaped, notched end which engages the ends of a spring and a limiting wire. The limiting wire and spring are attached at their other ends to a cross bar and a second tube in which the hinge element and the first tube may slide coaxially. A hand grip is also disclosed which consists of a central grip portion with two cylindrical parallel holes having slits on the outside thereof. At the outer edges of the slits are ribs which, when the outer portions of the grip are tightened, focus the compressive forces generated by the tightening toward the tube portions, thereby creating a strong frictional hold. The hinge and grip configurations are found in a bitubular orthopedic crutch having three sections. Utilizing the properties of the hinge element, the three sections may be folded one over another to reduce the size of the bitubular crutch to approximately ⅓ of its operating length.

17 Claims, 2 Drawing Sheets

ADJUSTABLE FOLDING WALKING AID

BACKGROUND OF THE INVENTION

1. Field of the Invention

The present invention relates generally to the art of hinges for vertical supports and their application in folding or reducing vertical supports, or other tubular elements which are capale of being folded, and more particularly to the art of walking aids that are capable of being reduced in size. More specifically, the present invention relates to application of such hinges in an orthopedic crutch that can be reduced to ⅓ of the operation length of such a walking aid.

2. Description of the Related Art

Many types and forms of means for allowing reduction in the length of vertical supports have been developed in the related areas of the art of the present invention. Poles, rods, canes and crutches have all been designed in ways that allow them to be reduced in size. However, there are several shortcomings in both the production and operation aspects of these inventions that would be desirable to cure.

U.S. Pat. No. 3,635,233 issued Jan. 18, 1972 to Robertson, shows a folding cane or crutch. A tension cord is attached to the top and bottom tubular segments and runs through any intermediate segments. The joints between segments are not hinges, but rather are formed by male and female fittings integral to the tubular segments. Robertson describes very narrowly the structure of the male/female fittings and emphasizes that they are to be integral to the tubular segments. The cane in Robertson is adjusted to a limited extent for height by changing the position of the hand grip as seen in FIG. 6. Because the device in Robertson is a single vertical support, there is no provision for minimizing or accomodating the torque exerted on the support.

The two U.S. Pat. No. to Hyman, No. 3,730,544 issued May 1, 1973 and Re. No. 28,067 issued July 9, 1974, show collapsible ski pole and rod structures. Hyman uses male/female type fittings generally similar to Robertson. A flexible tether cord runs the length of the pole. Mechanical cocking and locking means are provided for applying tension to the cord, thus locking the tubular segments into a linear configuration. Due to the nature of the devices shown in Hyman's two patents, naturally there is no way to adjust the vertical height of either device. Like Robertson, the Hyman patents do not disclose any means for minimizing torsional forces and no hinge structure is shown.

U.S. Pat. No. 3,655,297 issued to Bolen, Jr., et al on Apr. 11, 1972 discloses a coupling or joint for folding tubular parts—here, parts of a paddle. A single directional, three-piece hinged plug is anchored into one tube. The other end is slidably located in the second tube. Mounted at this second end is a screw threaded at both ends and narrower between the threadings. A nut is anchored inside the second tube. To secure the two tubes together, one pulls the plug into the second tube and screws the adjacent threading into the internal nut until the device is secure. Again, no means are shown for dealing with the torsional forces created when the device's supporting means is twisted. Bolen uses the typical hinged joint found in other earlier devices.

A spring-loaded folding cane is shown in U.S. Pat. No. 4,527,579 issued to Knotter, et al. on July 9, 1985. A relatively elaborate pivot joint is locked by the operator when a spring-loaded locking ring 33 is slipped over the axially aligned joint segments. To unlock the device in Knotter, the user pulls the locking ring up along the device's shaft against the biasing of the spring, and then, while holding the ring clear of the joint, folds the shaft. Once again, the problem of torsional forces is not addressed due to the nature of the device.

U.S. Pat. No. 3,886,962 issued to Diamontis on June 3, 1975 shows a collapsible crutch using a telescoping hinged joint and a relatively complex series of holes, buttons and slots. Again, the hinge is a three-piece affair such as that found in Bolen. A pair of identical latch buttons are moved along slots on the two tubular elements of the crutch to release the hinges, allowing the crutch to be folded. A mechanically specific structure is used to accomplish locking. Diamontis provides for adjustability by making the arm rest 5 adjustable by means of locking buttons 8. Diamontis specifically states that the crutch user needs another person to assist in adjusting the height using the disclosed structure since two lock buttons must be maintained in a depressed position while the arm rest is pulled out.

Finally, two U.S. Pat. Nos. 4,253,478 to Husa, issued Mar. 3, 1981 and 4,437,480 issued Mar. 20, 1984, show a folding crutch. A hinged plug is anchored to the lower tube of the crutch, while being slidable within the upper tube. The hinge is again the same as that seen in Diamontis and Bolen. To secure the two tubular segments, one pushes the plug up into the upper segment until a button locks the joint. The later Husa patent adds reinforcing rings outside the joint. Husa does not disclose any means for adjusting the height of the crutch nor dealing with torquing of the lower, single tube element.

Of the above patents, only Diamontis shows a collapsible crutch having more than one collapsible tubular member. All others show only a unitary folding or collapsing vertical support. Diamontis shows a collapsible crutch having more than one collapsible tubular member. All others show only a unitary folding or collapsing vertical support. Diamontis requires a pair of two-part locking mechanisms to assist the user in folding the crutch when not in use and also requires two people to adjust the operational height. Several of the other patents disclose aids that a user can fold without assistance, but, they sacrifice the added stability of having more than one vertical support. All of the earlier devices that use a hinge employ the standard three-piece element. A more easily and economically made hinge would represent an important advancement in the art. Additionally, a two support walking aid that could be both adjustable and reducible by the user alone would be a significant advancement in the art of reducible walking aids.

Another folding walking aid is disclosed in the U. S. application Ser. No. 06/867,099, also owned by Ortho Tech Industries Incorporated. As with all of the above subject matter references which incorporate any type of a hinge element, the device in this application utilizes a three-piece hinge which requires a central bridge portion which is pivotably attached to two anchoring points.

OBJECTS AND SUMMARY OF THE INVENTION

It is a primary object of the present invention to provide a new and economical hinge element for vertical supports such as a reducible or foldable walking aid that is easily reduced in size and easily restored to its operating structure by the user without assistance.

It is another object of the present invention to provide a reducible or foldable walking aid that does not require any mechanical locking or unlocking means.

It is a different object of the present invention to provide a reducible or foldable walking aid that is easily adjusted by one person, is adjusted for height above the hand grip and provides a wider range of adjustability then earlier devices.

It is yet another object of the present invention to provide a hinge element which may be incorporated in any tubular support structure which has only two elements forming the hinge itself.

It is a further object of the present invention to provide an adjustable and reducible walking aid that is easily produced and has fewer moving or mechanical parts than in devices in the related art.

It is still a different object of the present invention to provide a walking aid having a hand grip which frictionally engages the vertical members of the walking aid if more than one of those are present, and is more reliable in holding its position.

How these and other objects of the invention are accomplished will be described with reference to the following description of the preferred embodiment of the invention taken in conjunction with the figures. Generally, however, the objects are accomplished by providing a hinge element which consists of a tube connector attached to the end of a tube, the end of the tube connector having a notched head portion. Pivotably attached to the notched head of the connector is a bracket element having a spherically shaped, notched end which engages the ends of a spring and a limiting wire. The limiting wire and spring are attached at their other ends to a cross bar and a second tube in which the hinge element and the first tube may slide coaxially. The preferred embodiment of the invention thus eliminates several parts typically needed for a hinge element in earlier devices. A new hand grip is also disclosed which consists of a central grip portion with two cylindrical parallel holes having slits on the outside thereof. At the outer edges of the slits are ribs which, when the outer portions of the grip are tightened, focus the compressive forces generated by the tightening toward the tube portions, thereby creating a stronger frictional hold than was available in earlier devices. The hinge and grip configurations are found in a bitubular orthopedic crutch having three sections. Utilizing the properties of the hinge element, the three sections may be folded one over another to reduce the size of the bitubular crutch to approximately ⅓ of its operating length. Other ways in which the objects of the invention could be accomplished will become apparent to those skilled in the art after reading and understanding the present specification.

In the Figures like reference numerals are used to designate like components.

DESCRIPTION OF THE PREFERRED EMBODIMENT

Figure 1:
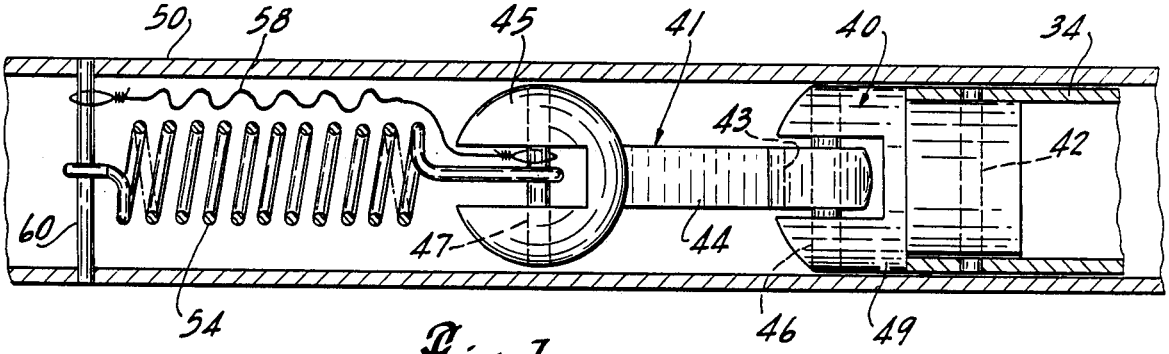
FIG. 1 is a cross sectional view of the hinging apparatus of the present invention in its operational configuration.
Figure 2:
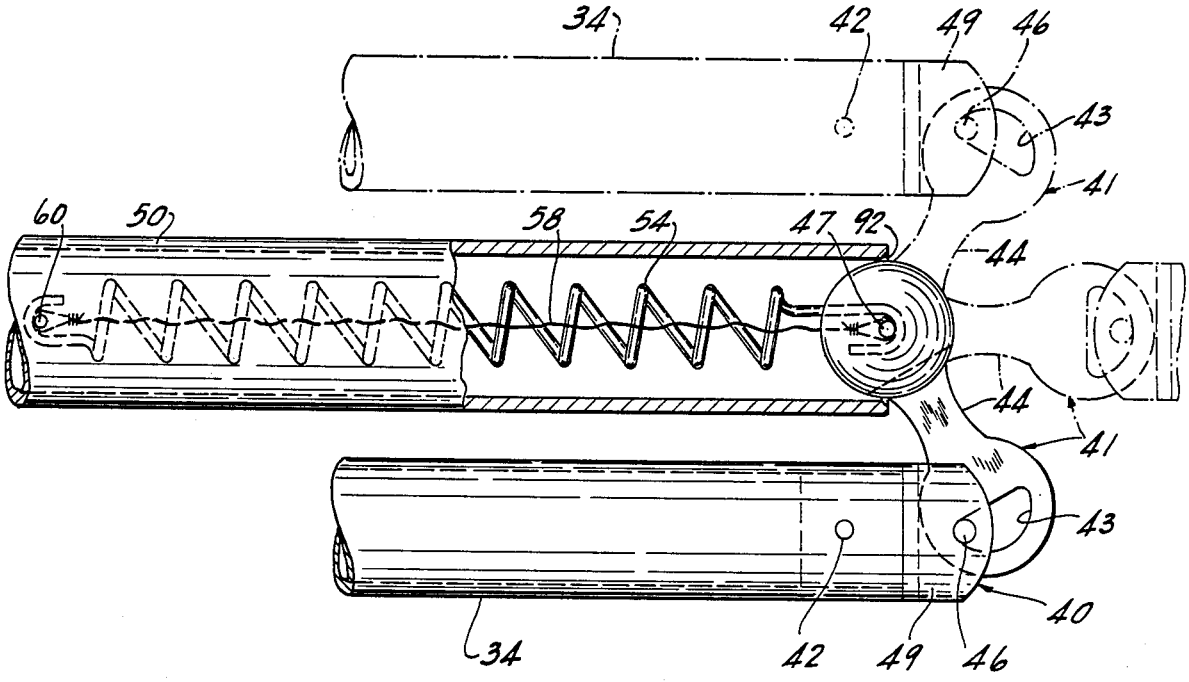
FIG. 2 is a cross sectional view of the hinging apparatus of the present invention in its folded configuration.
Figure 3:
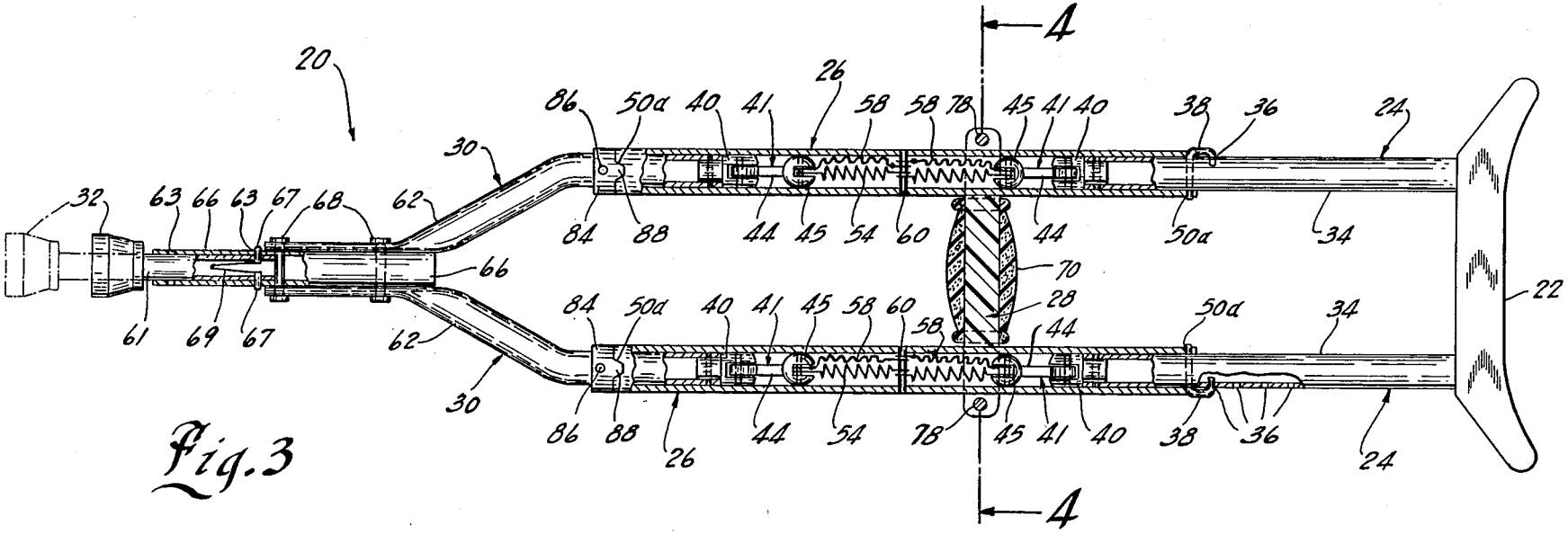
FIG. 3 is a plan view of a walking aid, partially in cross section, corporating the preferred embodiment of the present invention.

The preferred embodiment of the hinge of the present invention is shown in FIGS. 1, 2 and 3. The hinge consists of five basic elements: a spherically ended joint 41, a tube connector 40, a biasing element such as a spring 54, a limiting device such as a wire 58 and stopping means such as a collar 84. This configuration eliminates a number of elements required for earlier tubular hinges and thus provides a more easily built and operated hinge that is also considerably less expensive to produce.

FIG. 1 shows two tubes 34 and 50 joined in telescoping hinging fashion. Tube connector 40 is mushroom-shaped, having a notched head portion 49 with a pin 46 extending across the notch. The stem portion of connector 40 is anchored to the end of the tube 34, head 49 having the same cross-sectional shape and size as tube 34 in the preferred embodiment. Connector 40 is held in tube 34 by any appropriate means, such as a compression pin 42.

Joint 41 has, at one end, a spherical notched segment 45 with a pin 47 extending across the notch. At the opposing end is a generally circular planar segment having a D-shaped hole 43 cut therein. Hole 43 is engaged by pin 46 of connector 40. The two ends of joint 41 are joined by a bidirectional bridge 44. The diameter of spherical end 45 is approximately equal to the diameter of tube 34, and therefore slides within tube 50 as does tube 34.

Spring 54 and limiting wire 58 are anchored by pin 60 in tube 50. The other ends of spring 54 and wire 58 are attached to pin 47 in spherical segment 45. Wire 58 limits the extent to which the spherical end 45 can be withdrawn from tube 50, as illustrated in FIG. 2. Spring 54 holds tubes 34 and 50 in telescoping engagement unless the tubes are being pulled apart. The spherical end 45 helps in eliminating several elements from earlier devices. Because of its shape and orientation, spherical end 45 actually makes tube 50 a part of the hinge, in that the end of tube 50 is the pivot socket for spherical end 45. To assist in providing the proper socket, tube 50 has a 45° chamfer 92 around its inner edge at the end which accepts tube 34, as seen in FIG. 2.

As can be seen in FIG. 2, when the hinging apparatus is withdrawn to its limit, joint 41 acts as a lever arm with pin 47 as the center of rotation. Pin 46 slides to one corner of hole 43, thereby increasing the levering effect of joint 41. D-shaped hole 43 allows for translation of the pivot point between connector 40 and joint 41 along a curvilinear path to achieve the most effective changing of the pivot point. Binding between tube segments is eliminated because the actual length of joint 41 can be appreciably reduced. This naturally also leads to a more economical hinge to produce since the amount of materials needed is also reduced.

The typical three-piece hinging apparatus of earlier devices has thus been reduced to a two-piece structure which is equally versatile, e.g., being bidirectional. The configuration of hole 43 and its operational characteristics with joint 41 provide the means by which the two-piece hinge operates to accomplish full bidirectional folding. It is, just as importantly, considerably less expensive to produce.

This preferred embodiment of the hinge is shown incorporated in a bitubular orthopedic crutch in FIG. 3.

A crutch 20 consists generally of an arm rest 22, a first bitubular section 24, a second bitubular section 26 including a new hand grip 28, a third bitubular section 30 and a friction pod 32. Arm rest 22 and pod 32 are of conventional construction and are well known in the art.

The first bitubular section 24 consists of a pair of identical hollow tubes 34, the upper ends of which are mounted to arm rest 22 in any conventional fashion. The arm rest assists in minimizing the torsional forces that are exerted on the crutch when it is twisted in use, as well as providing rigid support means for the tubes 34 of first section 24. The tubes 34 shown in FIG. 3 are analogous in operation to the tube 34 shown in FIGS. 1 and 2. A cushion (not shown) of rubber or other pliable material is typically placed over the arm rest 22 to provide for the user's comfort. As seen in FIG. 3, each of the tubes 34 has holes 36 drilled through it. These holes are capable of holding pins 38, the purpose of which will be described in more detail below. The lower ends of tubes 34 have tube connectors 40 attached to the ends thereof.

The spherical ended joints 41 are slidable within tubes 50 of second section 26. Tubes 50 are slightly larger diameter than the tubes 34 so that tubes 34 of first section 24 can slide into coaxial engagement with the opposing tubes 50 of second section 26. The operation and general orientation of tubes 34 and 50 in FIG. 3 are identical to that of tubes 34 and 50 in FIGS. 1 and 2. The hinging configuration of first section 24 and second section 26 is symmetrically repeated between the third section 30 and second section 26. As can be seen from the illustrated application of the new hinge element in FIG. 3, the hinge configuration may be adapted to many other devices other than a bitubular crutch. For example, other walking aids or medical equipment such as walkers, unitubular crutches and canes could be adapted to incorporate the new hinge element as well. Other tubular supports which one may want to fold or otherwise reduce in size may also be adapted to use the hinge of the present invention. For example, tent poles, ski poles and other single and multiple tube structures could incorporate the hinge.

Returning to FIG. 3, the upper end of each tube 62 of third section 30 has anchored thereto a tube connector 40 identical to the connector 40 of first section 24. Once again, as seen in FIGS. 1 and 2, the bidirectional bracket 44 pivotally connects the connector 40 to spherical segment 45. In an alternate embodiment of this application, other biasing means, such as an elastic cord or cable, may be substituted for the spring 54 of the preferred embodiment. It should be noted here that the hinges, the limiting wire 58 and spring 54 are always isolated from the weight of the user. The only stress to which these elements are subjected is that of the weight of the lower part of the crutch itself and the actual elastic force created by springs 54.

The third bitubular section 30 consists of two tubes 62 that are parallel at the upper end of section 30, then converge toward one another near the bottom of section 30. Tubes 62 and tubes 34 are of the same diameter in the preferred embodiment of the present invention. At the lower end of section 30, a single tubular brace 66 is anchored between the tubes 62. Brace 66 is anchored by a pair of bolts 68 which further assist in accomodating torsional forces and provide a rigid support for the tubes 62 of the third section 30. Slidable within brace 66 in a manner to be described below is a tube 61 which has a friction pod 32 attached at the bottom.

Figure 4:
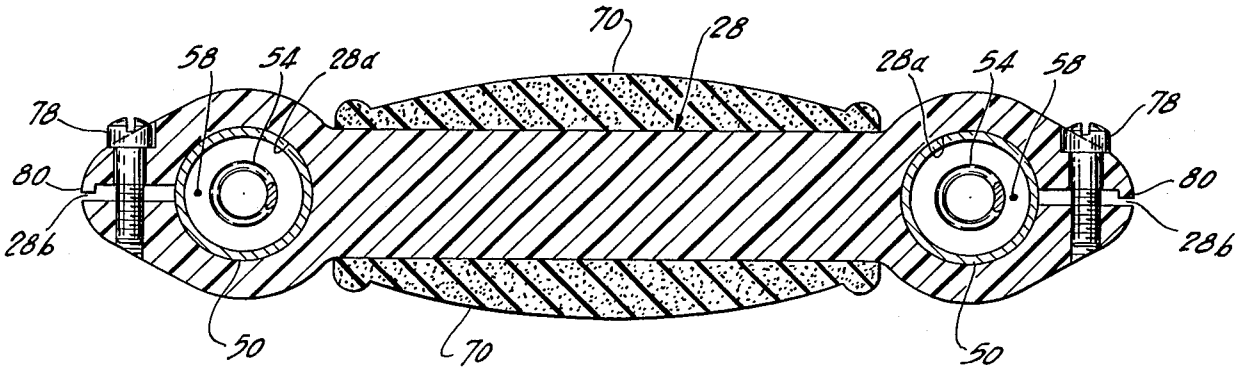
FIG. 4 is a cross sectional view of the handgrip of a walking aid employing the hinging apparatus of the present invention taken along line 4—4 of FIG. 3.

FIG. 4 illustrates the means for attaching the hand grip 28 to the tubes 50 of the second section 26. The grip 28 is a single piece with two holes **28*a* and side slots 28*b*. The two holes 28*a* are configured to maintain the tubes 50 in parallel alignment and prevent excessive twisting of the crutch when it is in its operational position. The two facing sections of grip 28 on either side of slot 28*b* are held together by button head screws 78 in the preferred embodiment. A rib 80 is present on the outer edge of each slot 28*b* so that the compressive forces caused by tightening of screws 78 are focused in toward each tube 50, rather than being distributed along the opposing faces that define slot 28*b*. The gripping sections of grip 28 are constructed so that a stable but infinitely adjustable grip is formed. Grip 28 provides still further anti-torquing means for those situations in which the crutch is twisted as well as a rigid support for the tubes 50. An overlay 70 of rubber or other pliable material is usually provided to increase the comfort and frictional handling characteristics of the grip 28**.

Tubes 62 engage tubes 50 in a way designed to prevent deformation of the tubes 50 even after repeated folding and unfolding, in addition to reducing torsional stresses on the crutch. Attached around each tube 62 is a collar 84. Collar 84 is held in place on tube 62 by a rivet 86. Collar 84 has an anti-torsion member 88 which is generally trapezoidal in shape in the preferred embodiment. Member 88 is designed to engage a recess **50*a* in tube 50 whenever tube 62 is brought into coaxial alignment within tube 50. Deformation of tube 50 is significantly reduced because of the distribution of forces. In addition, member 88 engages recess 50*a*** to prevent excessive twisting or torquing of the tubes when they are in an engaged position.

The elements of the crutch that actually support the weight of the user are the collars 84 and tubes 50 at the lower end where most of the weight is applied, and pins 38, holes 36 and tubes 50 at the upper end.

Adjustment of the crutch is a two step process. First, a rough adjustment for the height of the person using the crutch is made at the lower portion. As can be seen in FIG. 3, the tubes 62 after collapsing in toward one another are crush-formed about center tube 66. Tube 66 is mounted to tubes 62 by a pair of rivets 68 in the preferred embodiment. Slidable within the tube 66 is a second tubular element 61 to which is attached the friction pod 32. Holes 67 are located near the upper end of tube 61. They can be matched to either pair of holes 63 located in tube 66. If they are matched with the upper pair of holes 63, and held therein, the crutch is at rough setting for a person who is generally shorter. If, on the other hand, the holes 67 are matched to holes 63 at the lower end of tube 66, the crutch is rough set for a person who is generally taller. Fine adjustment, the primary way to adjust the height of the crutch, is accomplished using the series of holes 36 in tubes 34 along with pins 38 in the upper surfaces of tubes 50 which have small deformations in which the pins may rest. A number of holes 36 are located in the upper tubes 34, thereby allowing a large range of height adjustment based on the rough setting of the lower elements.

This system is extremely reliable since there is always a minimum force from the bias of the springs 54 to keep elements in place. Unlike the crutches of earlier patents, this device requires no locking mechanism for it to remain in a collapsed or operational configuration. A large rubber band or clip of some kind may be used to hold the crutch in its collapsed position once it is folded and is to be stored. The crutch 20 in FIG. 3 may also be quickly, easily and reliably adjusted by the user. This is accomplished by adjusting the position of pins 38 in holes 36 in the upper section 24.

A disabled individual can fold and unfold the crutch 20 without any assistance. When the crutch 20 is in its operational configuration as seen in FIG. 3, folding is accomplished by grasping the first section 24 and the second section 26 and pulling them away from each other. Once the hinge brackets 44 of joints 41 are generally clear of the tubes 50, the first section 24 is folded over the second section 26 in one direction. The third section 30 is folded in the opposite direction in a similar fashion to accomplish the complete folding of the crutch The resulting collapsed crutch is easily carried or stored.

When the user desires to open the crutch 20 to its operational position as seen in FIG. 3, he or she merely pivots the first section 24 and the third section 30 into general alignment with the second section 26. Tubes 62 and 34 then slide into tubes 50 to accomplish unfolding. An alternative method for opening the collapsed crutch 20 is to grasp the arm rest 22 and let the sections fall toward the ground and thus into general coaxial alignment with each other at which point the sections will automatically telescope together under the biasing force of the elastic cable 54.

As can be appreciated from the above discussion, a disabled individual can easily adjust, fold and unfold the crutch 20 employing the hinge of the present invention or any other similarly constructed device without assistance from another person. For example, a person can fold or unfold a walker with little or no assistance, thereby increasing their independence of movement and activity. Variations, modifications and other applications will become apparent to those skilled in the art. For example, the tubes hinged by the present invention could be in abutting engagement rather than telescoping engagement. Therefore, the above description of the preferred embodiment is to be interpreted as illustrative rather than limiting. The scope of the present invention is limited only by the scope of the claims that follow.

What is claimed is:

1. A bidirectional hinge for coaxially joining a first tube and a second tube, said hinge comprising:

a connector attached at one end of said first tube, said connector and said first tube being slidable within said second tube;

a bracket having a first end pivotably attached to said connector and having a generally spherical second end;

wherein said connector includes a head portion having a notch with a pin thereacross and wherein said first end of said bracket is circular and planar and has a hole therein which is engaged by said pin of said connector so as to permit pivoting of said bracket about said connector, the hole of said first end of said bracket being semi-circular, and oriented so that the linear portion of the hole is perpendicular to the axis of said second tube when said bracket is in said second tube;

means for stopping said first tube from sliding into said second tube beyond a preselected depth;

means for biasing said bracket and connector into said second tube; and means for limiting the extent to which said first tube, said connector and said bracket may be withdrawn from said second tube.

2. The hinge as recited in claim 1 wherein said stopping means comprises a collar fixed about said first tube, said collar having an anti-torsion member designed to engage a recess in the end of said second tube, so that when said second tube engages said collar, said first tube is prevented from sliding further into said second tube, deformation of said second tube is reduced, and twisting of said first tube relative to said second tube is eliminated.

3. The hinge as recited in claim 1 wherein said spherical second end of said bracket has a notch with a pin thereacross and wherein said biasing means and said limiting means engage said pin of said spherical second end.

4. The hinge as recited in claim 3 wherein said biasing means comprises a spring, one end of said spring being attached to said pin of said spherical second end and the other end of said spring being attached to a cross bar within said second tube.

5. The hinge as recited in claim 4 wherein said limiting means comprises a wire attached to said pin of said spherical second end and attached to said cross bar of said second tube.

6. A bidirectional hinge for coaxially joining a first tube and a second tube, said hinge comprising:

a connector secured to one end of said first tube, said connector including a head portion having a notch with a pin thereacross and said connector and said first tube being slidable within said second tube;

a bracket having a first end which is circular and planar having a hole therein which is pivotably engaged by said pin of said connector so as to permit pivoting of said bracket about said connector, said bracket also having a generally spherical second end having a notch with a pin thereacross;

wherein the hole of said first end of said bracket is semi-circular, and oriented such that the linear portion of the hole is perpendicular to the axis of said second tube when said bracket is in said second tube;

a collar fixed about said first tube; said collar having an anti-torsion member designed to engage a recess in the end of said second tube, so that when said second tube engages said collar, said first tube is prevented from sliding further into said second tube, deformation of said second tube is reduced, and twisting of said first tube relative to said second tube is elimimated;

means for biasing said bracket and connector into said second tube, said biasing means being attached to said pin of said spherical second end of said bracket and attached to a cross bar within said second tube;

means for limiting the extent to which said first tube, said connector and said bracket may be withdrawn attached to said pin of said spherical second end of said bracket and said cross bar.

7. The hinge as recited in claim 6 wherein said biasing means is a spring.

8. The hinge as recited in claim 6 wherein said limiting means is a wire.

9. A latchless reducible walking aid having integral adjustign and folding means, including at least three tubular sections, comprising:

a first section having one or more tubular members each having a first bidirectional hinge element anchored at one end thereof;

a second section having the same number of tubular members as said first section, each of said tubular members of said second section designed to coaxially and slidably accept one tubular member of said first section and one of said first hinge elements to a preselected depth within said tubular member of said second section, said first section being attached to said second section by limiting means designed to limit the separation of said sections;

a third section having the same number of tubular membes as said second section, each of said tubular members of said third section having a second bidirectinal hinge element anchored at one end thereof, each of said tubular members of said second section designed to coaxially and slidably accept one tubular member of said third section and one of said second hinge elements to a preselected depth within said tubular member of said second section, said third section being attached to said second section by limiting means designed to limit the separation of said sections;

means for adjusting the overall height of the crutch by adjusting the depth to which said tubular members of said first may slide into said tubular members of said second section;

wherein said means for permitting said second section to accept said first section to preselected depths includes a plurality of holes in said first section and pins insertable therein, said pins being further engageable with the ends of said tubular members of said second section;

wherein each of said first hinge elements comprises:

a connector attached at one end of each of said tubular members of said first section;

a bracket having a first end pivotably attached to said connector of said first hinge element, and having a generally spherical second end;

means for biasing said bracket and said connector of said first hinge element into said tubular member of said second section; and wherein each of said second hinge elements comprises:

a connector attached at one end of each of said tubular members of said third section;

a bracket having a first end pivotably attached to said connector of said second hinge element, and having a generally spherical second end; and means for biasing said bracket and said connector of said second hinge element into said second tubular members of section.

10. The reducible walking aid as recited in claim 9 wherein:

in each of said first hinge elements, said connector includes a head portion having a notch with a pin thereacross and wherein said first end of said bracket is circular and planar and has a hole therein which is engaged by said pin of said connector so as to permit pivoting of said bracket about said connector; and in each of said second hinge elements, said connector includes a head portion having a notch with a pin therearcross and wherein said first end of said bracket is circular and planar and has a hole therein which is engaged by said pin of said connector so as to permit pivoting of said bracket about said connector.

11. The reducible walking aid as recited in claim 10 wherein:

in each of said first hinge elements, said spherical second end of said bracket has a notch with a pin thereacross and wherein said biasing means and said limiting means engage said pin of said spherical second end; and in each of said second hinge elements, said spherical second end of said bracket has a notch with a pin thereacross and wherein said biasing means and said limiting means engage said pin in said spherical second end.

12. The reducible walking aid as recited in claim 11 wherein:

in each of said first hinge elements, said biasing means comprises a spring, one end of said spring being attached to said pin of said spherical second end and the other end of said spring being attached to a cross bar within one of said tubular members of said second section; and in each of said second hinge elements, said biasing means comprises a spring, one end of said spring being attached to said pin of said spherical second end and the other end of said spring being attached to a cross bar within one of said tubular members of said second section.

13. The reducible walking aid as recited in claim 12 wherein:

in each of said first hinge elements, said limiting means comprises a wire attached to said pin of said spherical second end and attached to said cross bar of one of said tubular members of said second section; and in each of said second hinge elements, said limiting means comprises a wire attached to said pin of said spherical second end and attached to said cross bar of one of said tubular members of said second section.

14. The reducible walking aid as recited in claim 11 wherein:

in each of said first hinge elements, the hole of said first end of said bracket is semi-circular, and oriented so that the linear portion of the hole is perpendicular to the axis of said tubular member of said second section when said bracket is in said tubular member of said second section; and in each of said second hinge elements, the hole of said first end of said bracket is semi-circular, and oriented so that the linear portion of the hole is perpendicular to the axis of said tubular member of said second section when said bracket is in said tubular member of said second section.

15. The reducible walking aid as recited in claim 9 wherein said third section further includes a pod element designed to enhance the frictional stability of said walking aid on the surface on which said aid is used, said pod element being attached to the end of said third section not having said second hinge elements attached thereto, said pod element being mounted to said third section by mounting means attached to said tubular members of said third section.

16. The reducible walking aid as recited in claim 15 wherein said mounting means comprises a plurality of rivets.

17. The reducible walking aid as recited in claim 9 further comprising anti-torsion means attached to said tubular members of said third section so that when said third section and said second section are in coaxial alignment and a preselected portion of said third section is in said second section, said anti-torsion means limit the amount of rotation between said second section and said third section, said anti-torsion means further providing an abuttment for said tubular members of said second section when in engagement with said tubular members of said third section so as to prevent deformation of the tubular members of said second section and to prevent said tubular members of said third section from sliding into said tubular members of said second section beyond a preselected depth.

* * * * *